US005147689A

United States Patent [19]

Igarashi et al.

[11] Patent Number: 5,147,689

[45] Date of Patent: Sep. 15, 1992

[54] METHOD FOR FORMING A COATING FILM WITH A RELIEF PATTERN

[75] Inventors: Hiroshi Igarashi, Nishinomiya; Osamu Terao, Taishibashi; Nobuhide Tsutsumi; Yukio Yamamoto, both of Neyagawa, all of Japan

[73] Assignees: Dai Nippon Toryo Co., Ltd., Osaka; Dai Nippon Insatsu Kabushiki Kaisha, Tokyo, both of Japan

[21] Appl. No.: 658,865

[22] Filed: Feb. 22, 1991

[30] Foreign Application Priority Data

Feb. 22, 1990 [JP] Japan ..... 2-41553

[51] Int. Cl.[5] ..... B05D 3/02; B05D 5/00

[52] U.S. Cl. ..... 427/264; 427/262; 427/265

[58] Field of Search ..... 427/257, 261, 264, 262, 427/265, 266

[56] References Cited

U.S. PATENT DOCUMENTS 3,811,915 5/1974 Burrell et al. ..... 427/262 X 4,233,343 11/1980 Barker et al. ..... 427/257 X

*Primary Examiner*—Evan Lawrence

*Attorney, Agent, or Firm*—Oblon, Spivak, McClelland, Maier & Neustadt

[57] ABSTRACT

A method for forming a coating film with a relief pattern, which comprises coating an undercoating material on a substrate surface to form a cured undercoating film, coating an intermediate coating material partly on the undercoating film in a desired pattern, drying it to such an extent that the amount of the solvent in the formed intermediate coating film is within a range of from 1 to 50% by weight, then overcoating a top coating material comprising, as binders, a polyester resin and an aminoplast resin cross-linking agent having a surface tension of at least 40 dyn/cm over the entire surface, followed by baking and curing to form a top coating film with the relief pattern.

10 Claims, 1 Drawing Sheet

METHOD FOR FORMING A COATING FILM WITH A RELIEF PATTERN

BACKGROUND OF THE INVENTION

1. Field of the Invention

The present invention relates to a method for forming a coating film with a relief pattern of decorative or artistic nature.

2. Discussion of Background

In recent years, reflecting demands for high quality products and diversification of demands by consumers, artistic or decorative products have been in demand which have coating films with relief patterns applied to various products including household electric appliances and building materials.

Heretofore, the following methods have been known as typical methods for applying relief patterns to such products:

(a) A method of coating a coating material having an additive having poor compatibility with the binder resin, such as silicone oil or an alkyl vinyl ether-type defoaming agent, incorporated therein (Japanese Unexamined Patent Publication No. 160670/1984).

(b) A method of coating a coating material having a foaming agent incorporated therein (Japanese Examined Patent Publications No. 6278/1988 and No. 11315/1990).

(c) A method of embossing an uncured coating film by means of an embossing plate (Japanese Examined Patent Publications No. 40076/1987 and No. 59030/1989).

However, the method (a) employs cissing and the method (b) employs foaming, to form coating films with speck-like relief patterns. Although artistic or decorative coating films may be thereby formed, it is thereby impossible to form optional desired relief patterns. Further, such methods have a problem that unless the amount of the additive is adjusted properly, the relief patterns tend to be non-uniform whereby the decorative or artistic nature tends to be impaired, and coating defects tend to result.

On the other hand, the above method (c) is capable of forming any desired relief pattern. However, this method cannot be applied to a thin film of a few tens micrometer. Further, this method is not suitable for the production of small quantities of various products. Furthermore, this method has a problem that the production efficiency is poor because of an increase in the number of process steps.

SUMMARY OF THE INVENTION

Under these circumstances, the present inventors have conducted extensive researches and as a result, have found a method whereby optional desired relief patterns can be formed even with a thin film of a few tens micrometer without necessity of incorporating the above-mentioned additive as a special third component. The present invention has been accomplished on the basis of this discovery.

Thus, the present invention provides a method for forming a coating film with a relief pattern, which comprises coating an undercoating material on a substrate surface to form a cured undercoating film, coating or printing (hereinafter commonly referred to as coating) an intermediate coating material or ink (hereinafter commonly referred to as an intermediate coating material) partly on the undercoating film in a desired pattern, partially drying it to such an extent that the amount of the solvent in the intermediate coating film is within a range of from 1 to 50% by weight, then overcoating a top coating material comprising, as binders, a polyester resin and an aminoplast resin having a surface tension of at least 40 dyn/cm over the entire surface, followed by baking and curing to form a top coating film with a ridge along the periphery of the intermediate coating film.

DETAILED DESCRIPTION OF THE PREFERRED EMBODIMENTS

Figure 1:
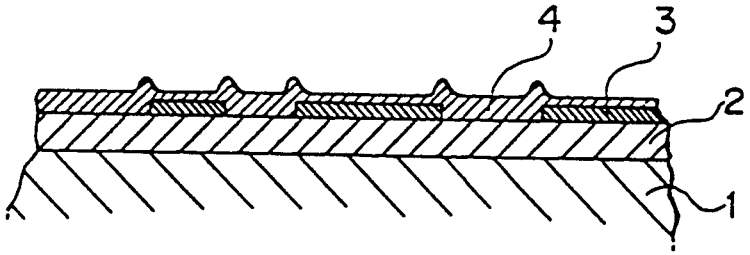
FIG. 1 is a cross-sectional side view illustrating an embodiment of the coating film with a relief pattern obtainable by the method of the present invention.

According to the present invention, as shown in FIG. 1, a cured undercoating film 2 is provided on the surface of a substrate 1, then an intermediate coating material is coated in a desired pattern thereon, and a specific top coating material is overcoated on the entire surface while the intermediate coating film 3 with such a pattern is still non-cured (namely, while the solvent still remains in a predetermined amount), whereby a phenomenon has been unexpectedly observed such that the top coating film 4 rises along the periphery of the intermediate coating film 3 to form a ridge.

Therefore, according to the method of the present invention, depending upon the pattern of the intermediate coating film 3, the top coating film 4 forms a ridge along the portion corresponding to the periphery of the pattern, and thus a coating film with a desired relief pattern can be formed. The mechanism for such a phenomenon has not yet been clearly understood. However, it may probably be such that the undercoating film 2 is cured, while the intermediate coating film 3 is not cured, whereby the former has a higher surface tension and more readily wettable, and when a top coating material containing an aminoplast resin having a high surface tension is coated, the coating material tends to move towards the one having a higher surface tension i.e. towards the undercoating film 2. Further, the intermediate coating film 3 undergoes a volume shrinkage due to the evaporation of the solvent. The above-mentioned phenomenon is believed to be caused by a synergistic effect of these actions.

Now, the present invention will be described in detail.

The undercoating material to be used in the present invention may be a naturally drying type coating material, but is preferably a baking type coating material. Specifically, it may typically be, for example, a commonly employed thermosetting resin coating material which comprises, as binders, a hydroxyl group-containing synthetic resin such as a polyester resin, an acrylate resin, an alkyd resin or an epoxy resin and a cross-linking agent such as a blocked polyisocyanate or an aminoplast resin and which has a solvent, a coloring pigment (include a metallic pigment or a pearlescent pigment), an extender pigment, various additives, etc. optionally incorporated. However, the undercoating material is not limited to such a typical example, and it may be any coating material so long as it has good adhesion to the top coating material which will be described hereinafter.

The intermediate coating material to be used in the present invention may be of the same type as the above-mentioned undercoating material. It is preferred to use the one having good adhesion to the undercoating material, i.e. to use binders of the same type as the binders of the undercoating material, or binders having good compatibility with the binders of the undercoating material.

As the solvent, it is preferred for the formation of relief patterns to use in combination a solvent having a low evaporation rate, for example, a glycol ether solvent such as ethylene glycol monobutyl ether, diethylene glycol monoethyl ether, diethylene glycol monobutyl ether or diethylene glycol monobutyl ether acetate, an aromatic solvent such as Solvesso 150 or 200 (manufactured by Exon Chemical Co.), Pegasol R-150 (manufactured by Mobil Petroleum Co.) or Swazol #1500 (manufactured by Maruzen Petrochemical Co.), or a ketone solvent such as isophorone, so that the solvent in the intermediate coating film will not evaporate rapidly.

The top coating material to be used in the present invention comprises, as essential components, a solvent and binders comprising a polyester resin and an aminoplast resin as its cross-linking agent, and it may further contain a coloring pigment (include a metallic pigment or a pearlescent pigment), an extender pigment, a modifier, various additives, etc. as the case requires. The above-mentioned polyester resin is the one obtainable by polymerizing a polybasic carboxylic acid with a polyhydric alcohol in accordance with a conventional method.

The polyhydric carboxylic acid may, for example, be o-phthalic acid, isophthalic acid, terephthalic acid, adipic acid, sebacic acid, azelaic acid, succinic acid, maleic acid or anhydrides thereof. The polyhydric alcohol may, for example, be ethylene glycol, diethylene glycol, neopentyl glycol, trimethylolpropane, 1,6-hexanediol, 1,4-butanediol, propylene glycol, glycerol or pentaerythritol.

Further, the hydroxyl value of the polyester resin is preferably from 5 to 150. The number average molecular weight is usually from 2,000 to 20,000, preferably from 5,000 to 10,000. If the number average molecular weight is larger than this range, the ridge tends to be slender. On the other hand, if it is smaller than the above range, the ridge tends to be not sharp, and the nature of relief tends to be low.

The above-mentioned aminoplast resin is a condensation product of an amino compound such as melamine, urea or benzoguanamine with an aldehyde compound, or a product obtained by further etherifying such a condensation product with an alcohol such as methanol or butanol. The aminoplast resin to be used in the present invention must have a surface tension of at least 40 dyn/cm (20° C.).

Namely, in the present invention, by using an aminoplast resin having the above specified surface tension, it is possible to form the above described relief pattern. If the surface tension is less than 40 dyn/cm, the product tends to have a poor relief finish, such being undesirable.

The blending ratio of the polyester resin to the aminoplast resin is preferably from 60/40 to 90/10 by weight of the solid content. These two binders are incorporated preferably in a total amount of from about 30 to 60% by weight in the coating material.

As the above-mentioned solvent, a usual solvent for coating materials such as a toluene, xylene, methyl ethyl ketone, cellosolve, ethyl acetate or ethylene glycol monobutyl ether, may be employed without any particular restriction. The solvent is preferably used in an amount such that the viscosity of the top coating material will be from about 20 to 100 seconds (Fordcup #4/20° C.).

Now, the method for forming a coating film with a relief pattern of the present invention will be described.

As the substrate to be coated according to the present invention, various metal materials such as a galvanized steel sheet, an aluminum plate and a stainless steel plate are preferred. However, the present invention can be applied also to other materials such as heat resistant plastic or inorganic materials.

Such a substrate may of course be the one having pretreatment such as degreasing or polishing treatment applied thereto, or a primer applied thereto, as the case requires.

In the process of the present invention, firstly, the undercoating material is coated on the substrate surface preheated as the case requires, by a usual coating method such as roll coating, flow coating, spray coating, electrostatic coating or dip coating and subjected to natural drying or bake-drying to form a cured undercoating film.

In the present invention, the cured (undercoating) film means a coating film sufficiently dried and cured to such an extent that when the intermediate coating material is coated thereon, it will not substantially be dissolved by the solvent in the intermediate coating material, e.g. to a gel ratio of at least 90%.

The dried film thickness of the undercoating film is optionally determined depending upon the type and the intended use of the substrate and is usually within a range of from 10 to 50 μm.

Then, on the cured undercoating film, the intermediate coating material is partially coated in a desired pattern.

When it is desired to form a random pattern, spray coating or brush coating is preferred as the coating method. On the other hand, when a specific desired pattern is to be formed, it is advisable to employ a printing method such as gravure printing, gravure offset printing, flexographic printing, screen printing or letterpress printing.

The intermediate coating material is coated preferably in such an amount that the dried film thickness would be about from 1 to 20 μm, whereby a coating film with excellent relief can be obtained.

Then, the top coating material is overcoated on the entire surface. The timing of the overcoating must be such that the overcoating is conducted when the amount of the solvent in the intermediate coating film has reached a level of from 1 to 50% by weight, preferably from 1.3 to 20% by weight.

If the content of the solvent in the intermediate coating material to be used is within the above range from the start, it is possible to coat that top coating material immediately after coating the intermediate material.

If the amount of the solvent is less than the above range, the difference from the undercoating film tends to be small. Consequently, it tends to be difficult to obtain a coating film with excellent relief. On the other hand, if the amount of the solvent exceeds the above range, the intermediate coating film tends to be dissolved in the top coating material and bleed out to impair the appearance of the coating film.

The amount of the solvent in the coating film can be calculated from the difference between the weight of the coating material used and the weight of the coating film. Accordingly, if the weight o-f the coating film is preliminarily recorded at certain intervals under the same conditions as the actual coating conditions, the amount of the solvent in the coating film can be judged from the time passed after the coating in the actual coating operation. This is practically convenient.

When the amount of the solvent in the intermediate coating film has reached a level within the above range, the top coating material is coated by a method such as roll coating, flow coating or spray coating. After the coating, the coated material is subjected to setting as the case requires and then baked for curing.

The baking conditions are optionally determined depending upon the coating material to be used. Usually, however, the baking is conducted at a temperature of from 150° to 250° C. for from 30 seconds to 20 minutes.

The average dried film thickness of the top coating film is preferably within a range of from about 10 to 30 μm. If the film thickness is outside this range, the relief of the resulting coating film tends to be poor.

According to the method of the present invention, an optional desired relief pattern can be formed without necessity of incorporating a third component additive or foaming agent which is likely to cause defects of the coating film, such as an additive having poor compatibility with binders or foaming agent, or without necessity of increasing the process steps as required in the embossing operation. Further, the present invention provides a feature that by using different colors for the undercoating film and the intermediate coating film in the desired pattern, it is possible to form a stereoscopic multicolored pattern, and thus it is possible to obtain a coating film having excellent decorative or artistic nature.

Now, the present invention will be described in further detail with reference to Examples. However, it should be understood that the present invention is by no means restricted by such specific Examples. In the following Examples, "parts" and "%" are represented by weight.

Coating materials having the following compositions were used as the undercoating material, the intermediate coating material and the top coating material:

| Undercoating material A | |
|---|---|
| Polyester resin solution *1) | 48.0 parts |
| Melamine resin *2) | 6.4 parts |
| Titanium oxide | 25.0 parts |
| Curing catalyst | 0.5 part |
| Leveling agent | 0.3 part |
| Solvesso #150 | 9.9 parts |
| Cyclohexanone | 9.9 parts |

*1): "Vylon 51CS", manufactured by Toyobo Co., Ltd. (solid content: 40%)
*2): "Cymel 303", manufactured by Mitsui-Cyanamid Ltd.

The coating material used was the one adjusted with a diluting solvent (a solvent mixture of xylene/Solvesso #100/cyclohexanone/cellosolve acetate =20/30/30/20) to a viscosity of 30 seconds (Fordcup #4/20° C.) prior to the coating.

| Undercoating material B | |
|---|---|
| Acrylate resin solution *3) | 48.0 parts |
| Melamine resin solution *4) | 11.4 parts |
| Epoxy resin solution *5) | 4.9 parts |
| Titanium oxide | 30.0 parts |
| Leveling agent | 0.3 part |
| Xylene | 2.7 parts |
| n-Butanol | 2.7 parts |

*3): "Almatex 781-26", manufactured by Mitsui Toatsu Chemicals, Inc. (solid content: 50%)
*4): "Uvan 20SE", manufactured by Mitsui Toatsu Chemicals, Inc. (solid content: 60%)
*5): "Epikote 1001", manufactured by Yuka Shell Epoxy Kabushiki Kaisha (K.K.) (solid content: 70%)

The coating material used was the one adjusted with a diluting solvent (a solvent mixture of xylene/Solvesso #100/methyl isobutyl ketone/isobutanol=20/65/10/5) to a viscosity of 30 seconds prior to the coating.

| Intermediate coating material I | |
|---|---|
| Alkyd resin solution *6) | 40.0 parts |
| Melamine resin solution *7) | 20.0 parts |
| Titanium oxide | 23.0 parts |
| Titan Yellow | 10.0 parts |
| Butyl cellosolve | 7.0 parts |

*6): "Phtalkyd 133-60S", manufactured by Hitachi Kasei Chemical Co., Ltd. (solid content: 60%)
*7): "Melan 28D", manufactured by Hitachi Kasei Kogyo K.K. (solid content: 60%)

The coating material used was the one adjusted with a diluting solvent (a solvent mixture of Solvesso #100/butyl cellosolve=40/60) to a viscosity of 20 seconds prior to the printing.

| Intermediate coating material II | |
|---|---|
| Alkyd resin solution *8) | 74.6 parts |
| Melamine resin solution *7) | 4.6 parts |
| Pearlescent pigment | 8.0 parts |
| Solvesso #100 | 4.8 parts |
| Butyl cellosolve | 8.0 parts |

*8) "Phtalkyd 804-70A", manufactured by Hitachi Kasei Chemical Co., Ltd. (solid content: 70%)

The coating material used was the one adjusted with a diluting solvent to a viscosity of 20 seconds in the same manner as in the case of the intermediate coating material I.

| Intermediate coating material III | |
|---|---|
| Acrylate resin solution *9) | 35.0 parts |
| Acrylate resin solution *10) | 21.0 parts |
| Melamine resin solution *4) | 11.7 parts |
| Titanium oxide | 25.0 parts |
| Cyanine Blue | 1.0 part |
| Butyl cellosolve | 6.3 parts |

*9) "Almatex 749-17AE", manufactured by Mitsui Toatsu Chemicals, Inc. (solid content: 50%)
*10) "Almatex 748-16AE", manufactured by Mitsui Toatsu Chemicals, Inc. (solid content: 50%)

The coating material used was the one adjusted with a diluting solvent to a viscosity of 20 seconds in the same manner as in the case of the intermediate coating material I.

Top Coating Materials T-1 to T-9

The compositions of these coating materials are shown in the following Table 1.

TABLE 1

| Top coating material No. | T-1 | T-2 | T-3 | T-4 | T-5 | T-6 | T-7 | T-8 | T-9 |
|---|---|---|---|---|---|---|---|---|---|
| Polyester resin solution *11) | 70.0 | 70.0 | 70.0 | 67.5 | 45.5 | | | | |
| Polyester resin solution *12) | | | | | | 72.0 | | 72.0 | |
| Polyester resin solution *13) | | | | | | | 70.0 | | 70.0 |
| Melamine resin solution *14) | 18.8 | | | | | 22.5 | 18.8 | | |
| Melamine resin *15) | | 15.0 | | | 9.8 | | | | |
| Melamine resin *16) | | | 15.0 | | | | | 18.0 | 15.0 |
| Melamine resin solution *17) | | | | 18.8 | | | | | |
| Titanium oxide | | | | | 32.5 | | | | |
| Curing catalyst | | 1.0 | 1.0 | | 0.6 | | | 1.0 | 1.0 |
| Defoaming agent | 0.2 | 0.2 | 0.2 | 0.2 | 0.1 | | 0.2 | | 0.2 |
| Solvesso #150 | 7.7 | 9.7 | 9.7 | 9.5 | 8.0 | 3.9 | 7.7 | 6.3 | 9.7 |
| Cyclohexanone | 3.3 | 4.1 | 4.1 | 4.0 | 3.5 | 1.6 | 3.3 | 2.7 | 4.1 |

(Unit: parts)

*11): A 50% solution of a polyester resin having a hydroxyl value of 15, a glass transition temperature of 12° C. and a number average molecular weight of 10,000 (solvent: a solvent mixture of Solvesso #150/cyclohexanone/cellosolve acetate = 2/7/1)

*12): A 60% solution of a polyester resin having a hydroxyl value of 65, a glass transition temperature of 20° C. and a number average molecular weight of 3,000 (solvent: a solvent mixture of Solvesso #100/methyl isobutyl ketone = 9/1)

*13): A 50% solution of a polyester resin having a hydroxyl value of 80, a glass transition temperature of 30° C. and a number average molecular weight of 8,000 (solvent: a solvent mixture of Solvesso #150/cyclohexanone/isophorone = 6/3/1)

*14): "Cymel 325", manufactured by Mitsui-Cyanamid Ltd. (solid content: 80%; solvent: isobutanol; surface tension of the melamine resin: 40.5 dyn/cm)

*15): "Cymel 303", manufactured by Mitsui-Cyanamid Ltd. (surface tension of melamine resin: 40.7 dyn/cm)

*16): "Cymel 232", manufactured by Mitsui-Cyanamid Ltd. (surface tension of melamine resin: 34.2 dyn/cm)

*17): "Uvan 225", manufactured by Mitsui Toatsu Chemicals, Inc. (solid content: 60%; solvent: a solvent mixture of n-butanol/xylene = 7/3; surface tension of melamine resin: 30.0 dyn/cm)

The above coating materials used were those adjusted with a diluting solvent to a viscosity of 30 seconds in the same manner as in the undercoating material A.

EXAMPLES 1 to 12 and COMPARATIVE EXAMPLES 1 to 10

On the surface of an electrically galvanized steel sheet having a polyester resin primer applied thereto, the undercoating material as identified in Table 2 was coated by a flow coater so that the dried film thickness would be 20 μm, and baked at 200° C. for 50 seconds.

Then, the sheet temperature was cooled to 60° C., and the intermediate coating material as identified in Table 2 was printed by a gravure printing machine partially on the undercoating film in a pattern of specks so that the dried film thickness would be about 2 μm.

When the amount of the solvent in the coating film with the speck pattern became the level as identified in Table 2, the top coating material as identified in Table 2 was coated by a flow coater so that the average dried film thickness would be 15 μm, and baked at 230° C. for 3 minutes.

The resulting coated sheet showed the degree of relief as identified in the bottom line in Table 2.

As is apparent also from Table 2, in the coating films of Examples 1 to 12 according to the method of the present invention, the top coating films were formed with rised portions along the peripheries of the speck patterned intermediate coating layers, whereby ridges were formed in correspondence with the shapes of the speck patterns. Thus, coating films having stereoscopic artistic designs were obtained.

Whereas, in Comparative Examples 1, 3 and 9 wherein the top coating material was coated when the amount of the solvent in the intermediate coating film was larger than 50% by weight, bleeding was observed in the coating film, and the appearance was poor.

On the other hand, in Comparative Examples 2, 4 and 10 wherein the top coating material was coated when the amount of the solvent in the intermediate coating film became less than 1% by weight, no relief was observed in each case.

Further, in Comparative Examples 5, 6, 7 and 8 wherein a melamine resin having a surface tension of less than 40 dyn/cm was incorporated as a component constituting the top coating material, no relief was observed in each case.

TABLE 2

| | Examples | | | | | | | | | | | |
|---|---|---|---|---|---|---|---|---|---|---|---|---|
| | 1 | 2 | 3 | 4 | 5 | 6 | 7 | 8 | 9 | 10 | 11 | 12 |
| Undercoating material | A | A | A | A | B | B | A | A | A | A | A | A |
| Intermediate coating material | I | I | I | I | II | II | I | I | I | I | III | III |
| Amount of the solvent (%) *19) | 43.7 | 21.3 | 5.4 | 1.3 | 36.2 | 2.8 | 5.4 | 5.4 | 5.4 | 5.4 | 46.3 | 18.7 |
| Top coating material | T-1 | T-1 | T-1 | T-1 | T-1 | T-1 | T-2 | T-5 | T-6 | T-7 | T-2 | T-2 |
| Relief of the coating film *18) | ◎ | ◎ | ◎ | ◎ | ◎ | ◎ | ◎ | ◎ | ○ | ◎ | ○ | ◎ |

| | Comparative Examples | | | | | | | | | |
|---|---|---|---|---|---|---|---|---|---|---|
| | 1 | 2 | 3 | 4 | 5 | 6 | 7 | 8 | 9 | 10 |

TABLE 2-continued

| | | | | | | | | | | |
|---|---|---|---|---|---|---|---|---|---|---|
| Undercoating material | A | A | B | B | A | A | A | A | A | A |
| Intermediate coating material | I | I | II | II | I | I | I | I | III | III |
| Amount of the solvent (%) *19) | 54.6 | 0.8 | 62.0 | 0.3 | 5.4 | 5.4 | 5.4 | 5.4 | 53.4 | 0.5 |
| Top coating material | T-1 | T-1 | T-1 | T-1 | T-3 | T-4 | T-8 | T-9 | T-2 | T-2 |
| Relief of the coating film *18) | xx | x | xx | x | Δ | x | x | x | xx | x |

*18): Visual evaluation
◎: Excellent relief
○: Good relief
Δ: Relief slightly observed but not sharp
x: No relief observed
xx: Bleeding observed and poor finished appearance
*19): The amount (%) of the solvent in the intermediate coating film immediately before coating the top coating material.

What is claimed is:

1. A method for forming a coating film with a relief pattern, which comprises coating an undercoating material on a substrate surface to form a cured undercoating film, coating an intermediate coating material partly on the undercoating film in a desired pattern, drying it to such an extent that the amount of the solvent in the formed intermediate coating film is within a range of from 1 to 50% by weight, then overcoating a top coating material comprising, as binders, a polyester resin and an aminoplast resin cross-linking agent having a surface tension of at least 40 dyn/cm over the entire surface, followed by baking and curing to form a top coating film with said relief pattern.

2. The method according to claim 1, wherein each of the undercoating material and the intermediate coating material comprises, as binders, a hydroxyl group-containing synthetic resin selected from the group consisting of a polyester resin, an acrylate resin, an alkyd resin and an epoxy resin, and a cross-linking agent selected from the group consisting of a blocked polyisocyanate and an aminoplast resin.

3. The method according to claim 1, wherein the intermediate coating material contains a glycol ether solvent, an aromatic solvent or a ketone solvent.

4. The method according to claim 1, wherein the polyester resin in the top coating material is the one obtained by polymerizing a polybasic carboxylic acid selected form the group consisting of o-phthalic acid, isophthalic acid, terephthalic acid, adipic acid, sebacic acid, azelaic acid, succinic acid, maleic acid and anhydrides thereof, and a polybasic alcohol selected from the group consisting of ethylene glycol, diethylene glycol, neopentyl glycol, trimethylolpropane, 1,6-hexanediol, 1,4-butanediol, propylene glycol, glycerol and pentaerythritol.

5. The method according to claim 1, wherein the polyester resin in the top coating material has a hydroxyl value of from 5 to 150.

6. The method according to claim 1, wherein the polyester resin in the top coating material has a number average molecular weight of from 2,000 to 20,000.

7. The method according to claim 1, wherein the blending ratio of the polyester resin to the aminoplast resin is preferably from 60/40 to 90/10 by weight of the solid content.

8. The method according to claim 1, wherein the total amount of the polyester resin and the aminoplast resin in the top coating material is from 30 to 60% by weight.

9. The method according to claim 1, wherein the undercoating film has a dried film thickness of from 10 to 50 μm, the intermediate coating film has a dried film thickness of from 1 to 20 μm, and the top coating film has an average dried film thickness of from 10 to 30 μm.

10. The method according to claim 1, wherein the intermediate coating material coated on the undercoating film is dried to such an extent that the amount of the solvent in the formed intermediate coating film is within a range of from 1.3 to 20% by weight.

* * * * *